United States Patent [19]

McLean et al.

[11] 3,949,468

[45] Apr. 13, 1976

[54] COMPACT POWER OPERATED CAN OPENER WITH COMPOUND PIERCING LEVER, POWER PIERCE, AND REMOVABLE CUTTER MOUNTING PLATE

[75] Inventors: Robert E. McLean, Raytown, Mo.; Leo F. Aberer, Shawnee Mission, Kans.; James B. Aberer, Greenwood, Mo.

[73] Assignee: Rival Manufacturing Company, Kansas City, Mo.

[22] Filed: Jan. 30, 1975

[21] Appl. No.: 545,597

[52] U.S. Cl. ..... 30/4 R

[51] Int. Cl.[2] ..... B67B 7/38

[58] Field of Search ..... 30/4 R, 8, 8.5, 9

[56] References Cited

UNITED STATES PATENTS

| | | | |
|---|---|---|---|
| 3,487,542 | 1/1970 | Hamwi | 30/4 R |
| 3,688,400 | 9/1972 | Aberer | 30/4 R |
| 3,689,998 | 9/1972 | Hahn | 30/4 R |
| 3,787,967 | 1/1974 | McLean | 30/4 R |
| 3,858,313 | 1/1975 | Yamaguchi | 30/4 R |

*Primary Examiner*—Al Lawrence Smith
*Assistant Examiner*—Gary L. Smith
*Attorney, Agent, or Firm*—Lowe, Kokjer, Kircher

[57] ABSTRACT

A compact, electrically powered can opener with power pierce has a compound piercing lever comprised of a pivotally mounted hand lever and an interconnected, removable cutter mounting plate. The cutter mounting plate is removably and pivotally connected to the frame by a pin member latching combination. A first pin member extends rearwardly from the cutter mounting plate and is received in a suitable aperture in the can opener frame to pivotally attach the cutter mounting plate thereto. A cooperating latching combination, comprised of a latch arrangement located between the cutter mounting plate and the can opener frame and a slotted frame aperture which cooperates with a second, rearwardly extending cutter mounting plate pin, firmly maintains the cutter mounting plate in correct alignment with respect to the frame as the cutter mounting plate pivots, precluding axial separation therebetween throughout a major portion of the pivot arc. However, when the cutter mounting plate is rotated to a predetermined angular position, the latching combination disengages for easy removal of the cutter mounting plate from the can opener frame. A third pin member, also extending rearwardly from the mounting plate, engages a suitably constructed slot in the hand lever so that manipulation of the hand lever correspondingly effects proper movement of the cutter mounting plate. The slot in the hand lever is uniquely shaped to insure recapture of the mounting plate third pin member when the removable mounting plate is reattached to the frame. Motor activation means, interconnected with the piercing lever, activates the motor in response to upwardly directed forces on the hand lever occurring when the cutter wheel engages a can, thereby effectuating power pierce. Additionally, when a can is not in the opener, the heel portion on the piercing lever enables it to fulcrum on a frame boss in response to minimal piercing lever movement, thereby actuating the motor and operating accessory cutlery grinding means (when same is provided) without additional switches.

11 Claims, 11 Drawing Figures

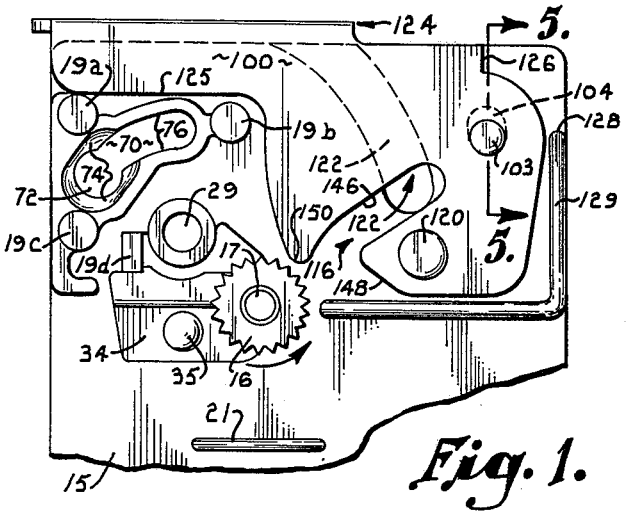
Fig. 1.
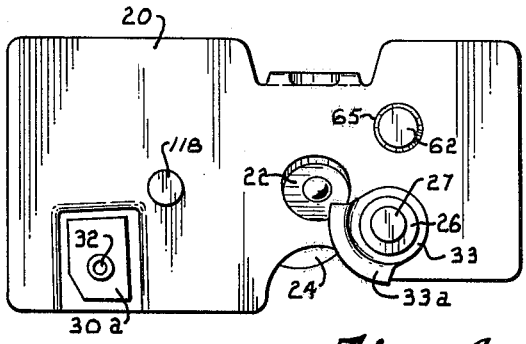
Fig. 4.
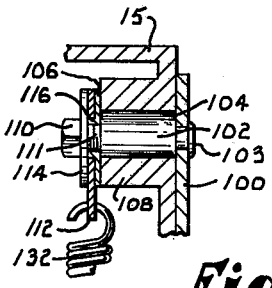
Fig. 5.
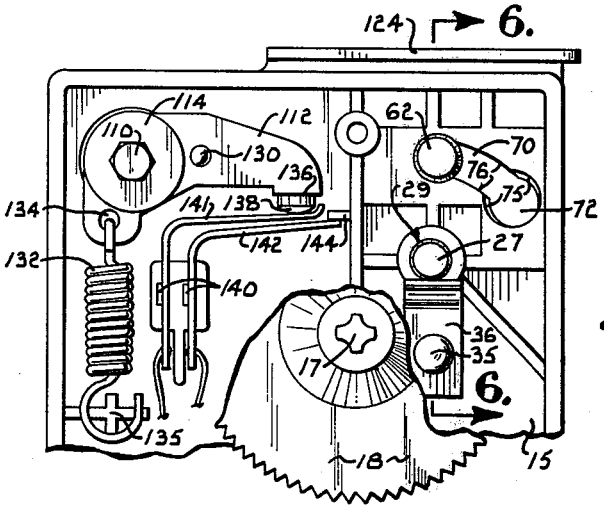
Fig. 2.
Fig. 3.
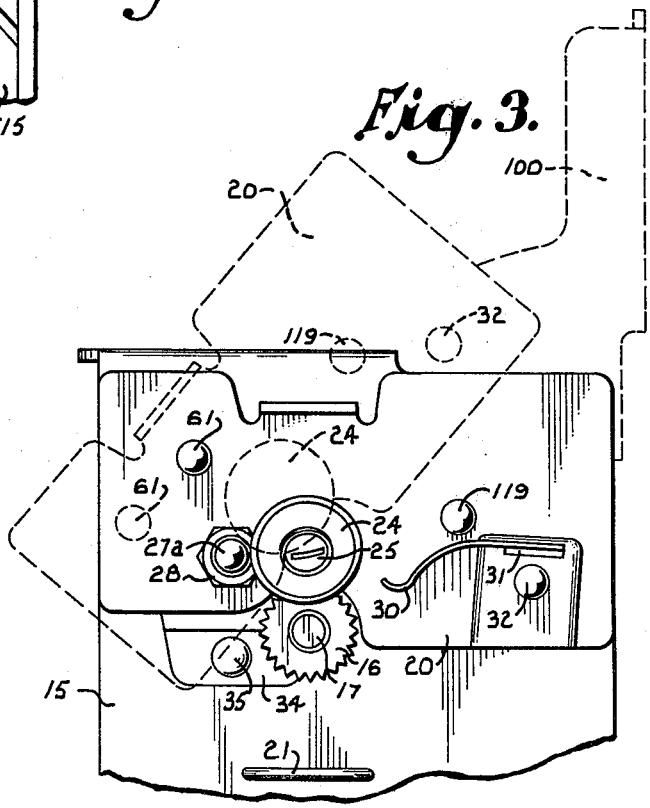
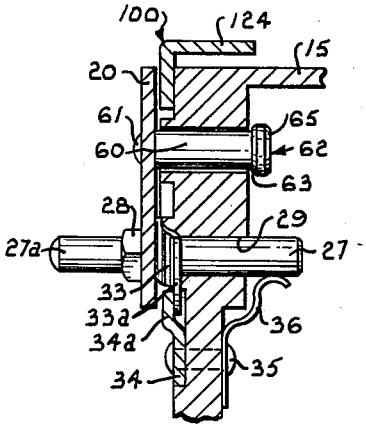
Fig. 6.

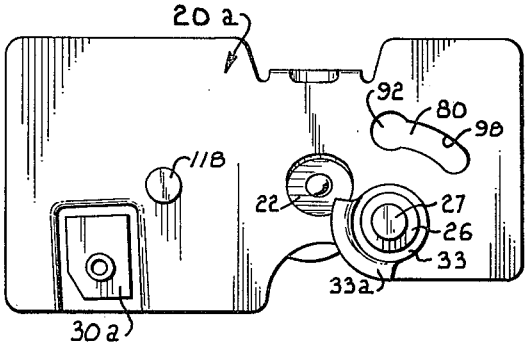
Fig. 10.
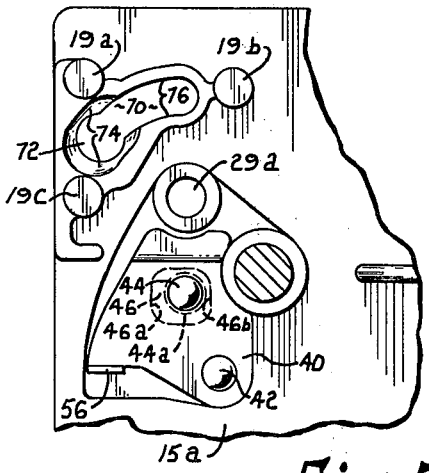
Fig. 7.
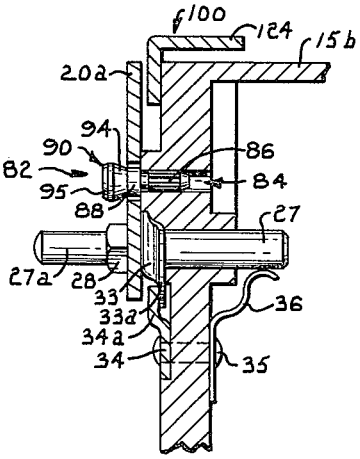
Fig. 11.
Fig. 8.
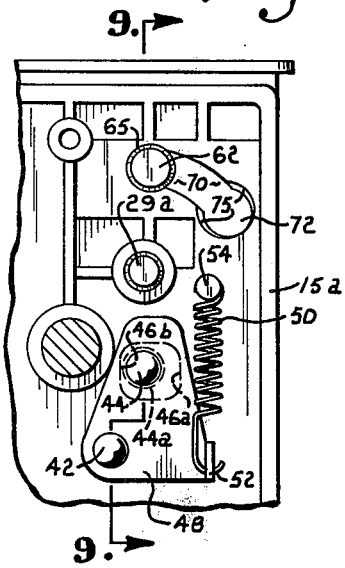
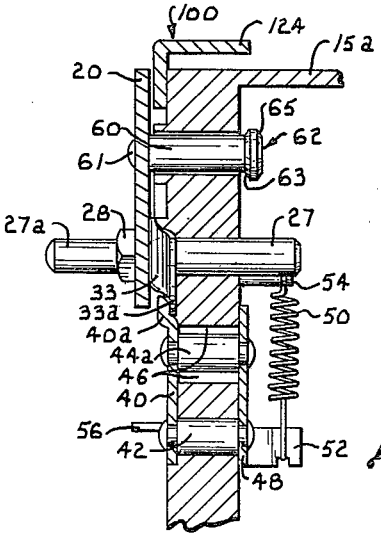
Fig. 9.

COMPACT POWER OPERATED CAN OPENER WITH COMPOUND PIERCING LEVER, POWER PIERCE, AND REMOVABLE CUTTER MOUNTING PLATE

BACKGROUND AND BRIEF DESCRIPTION OF THE INVENTION

This invention relates generally to electrically powered can openers. More specifically the invention relates to can openers of the type having power pierce and easily removable cutter mounting plates. The power pierce feature has been disclosed in U.S. Pat. No. 3,078,568, issued Feb. 26, 1963, and removability of the center mounting plate by means of a fixed latch and a cooperating fixed latch plate has been discussed in U.S. Pat. No. 3,688,400, issued Sept. 5, 1972. Both of the above patents are owned by the same assignee as in the subject invention.

Our invention includes a vertically oriented frame on which a cutter mounting plate and an interconnected hand piercing lever (which together comprises a compound piercing lever) are operably mounted. The hand piercing lever is pivotally attached to the can opener frame by a pin member which extends rearwardly from the piercing lever through a vertically oriented, oval-shaped aperture in the frame.

The cutter mounting plate is removably and pivotally attached to the can opener frame by a first pin member and a cooperating latching combination. The pin member extends rearwardly from the cutter mounting plate and engages a second frame aperture to facilitate pivotal rotation of the cutter mounting plate about said second frame aperture. The latching combination firmly but removably connects the cutter mounting plate to the can opener frame, precluding axial separation therebetween for a major portion of the cutter mounting plate pivot arc.

The latching combination includes a preferably stationary latch plate mounted to the can opener frame and a cooperating, selectively disengageable latch, mounted on the rear of the cutter mounting plate. When the cutter mounting plate is rotated to a preselected non-operative, angular position, the latch becomes disengaged from the latch plate and the cutter mounting plate may be easily removed. In an alternative embodiment of this invention the latch plate must be rotated slightly by the user (by depressing a suitable tab thereon) to facilitate disengagement of the cutter mounting plate. The latching combination also includes a second pin member which extends rearwardly from the cutter mounting plate to engage an arcuate slot in the can opener frame. A cap portion, located on the second pin member and having a slightly larger diameter than the pin member, cooperates to correctly locate the cutter mounting plate for easy removal or re-installation. The slot and pin assembly cooperate simultaneously with the aforementioned latch and latch plate combination to promote operative reliability. In another embodiment of this invention a capped pin member extends generally outwardly from the can opener surface (in which it is anchored) to engage an arcuate slot provided in a modified cutter mounting plate.

The hand piercing lever initiates and controls the movement of the cutter mounting plate. Accordingly, a third pin member also extends rearwardly from the cutter mounting plate toward the can opener frame and through an appropriately shaped slot in the piercing lever. The piercing lever is located between the cutter mounting plate and the can opener frame. Movement of the piercing lever thereby causes the cutter mounting plate to pivot to the desired operative position. Additionally, the hand piercing lever and the slot therein are constructed to facilitate positive re-engagement with the third cutter mounting plate pin member during re-attachment of the mounting plate to the can opener frame.

It is a primary object of this invention to provide a can opener having the aforementioned features wherein only minimal manual force is required to operate the piercing lever when piercing the end of an engage can. This is particularly important in regard to compact, small or miniature can openers since the forces developed by prior art designs tend to rotate or tilt smaller can openers during the can opening operation.

Accordingly, a compound piercing lever has been provided, which includes a pivoted hand piercing lever and a cooperating interconnected (removable) cutter mounting plate. Compounding has been accomplished, in part, by pivoting the hand piercing lever to the can opener frame and mechanically linking it to the cutter mounting plate (by means of a pin and slot) which in turn is pivoted to the frame. The resultant torque advantage from the lever combination facilitates the ease with which a can may be opened.

It is a further object of this invention to provide a can opener with the aforementioned compound piercing lever which includes an easily detachable cutter mounting plate. Accordingly, a detachable latching arrangement (described in U.S. Pat. No. 3,688,400) has been incorporated in the subject design, enabling the cutter mounting plate to be removed from the can opener frame when pivoted to a predetermined, substantially 43° position by the cooperating hand piercing lever. However, to accomplish this, the cutter mounting plate and the hand piercing lever have been uniquely interconnected by means of the aforementioned pivot and slot assembly. The said assembly is constructed so that the hand piercing lever slot will automatically re-engage the cutter mounting plate pin as the can piercing lever is swung counterclockwise (when viewed from the front) to reattach the cutter mounting plate.

It is another object of this invention to provide, in a can opener having the previously described advantages, a compound piercing lever which will facilitate initiation of the motor means for power pierce operation. Accordingly, when force is developed by engaging a can end between the cutter wheel (on the cutter mounting plate) and the can feed wheel (on the frame), upwardly directed movement of the piercing lever (which is made possible by the oval shape of the aperture through which the piercing lever pivot pin extends) actuates an internally located electric switch.

It is yet another object of this invention to provide a can opener hand piercing lever of the character described which additionally will actuate the can opener motor means when the lever is moved slightly by the user when no can is being opened. This is of great advantage where cutlery grinding means, for example, is provided on the can opener in that the inclusion of an extra switch has thereby been avoided. Accordingly, the hand piercing lever has been constructed with a unique "heel portion" which fulcrums on a frame boss to effect the vertical upward movement of the hand lever necessary to activate the motor. This same hand lever construction may be used with can openers not featuring cutlery grinding means (or other motor driven accessories) so that production costs are minimized by the concomitant standardization.

It is yet another object of the subject invention to provide a can opener of the type described above which has the advantage of structure condensation. The construction of the compound piercing lever, which minimizes the tendency of a can opener to "tip over", and the inclusion of the multi-functional hand piercing lever, together with other previously described features, facilitates the ability to reduce the size of the can opener structure. As a direct result, costs of manufacturing and shipping the unit are significantly reduced. Further, the unit occupies less space when it is displayed in retail stores or used in the consumer's home.

Other and further objects of the invention, together with the features of novelty appurtenant thereto, will appear in the course of the following description.

DETAILED DESCRIPTION OF THE INVENTION

In the accompanying drawings, which form a part of the specification and are to be read in conjunction therewith, and in which like reference numerals are employed to indicate like parts in the various views:

FIG. 1 is a front elevational view of the upper portion of the can opener frame with the cutter mounting plate omijtted and with the hand piercing lever shown in rest position;

FIG. 2 is a rear elevational view of the can opener frame portion shown in FIG. 1 with the casing removed and the motor and associated drive gear reduction gearing omitted;

FIG. 3 is a front elevational view of the upper portion of the can opener frame with the cutter mounting plate and the hand piercing lever attached thereto and with the broken lines indicating the position to which the hand lever and the cutter mounting plate may be moved to effect the removal of the latter;

FIG. 4 is a rear elevational view of the cutter mounting plate removed from the can opener;

FIG. 5 is a fragmentary sectional view of the hand piercing lever pivot pin assembly taken along line 5—5 of FIG. 1;

FIG. 6 is a fragmentary sectional view of the cutter mounting plate latch and pin assembly taken along line 6—6 of FIG. 2;

FIG. 7 is a fragmentary front elevational view of a modified can opener frame with the cutter mounting plate and hand piercing lever omitted and showing the manually depressible latch plate;

FIG. 8 is a fragmentary, rear elevational view of the can opener frame shown in FIG. 7;

FIG. 9 is a fragmentary, sectional view taken through line 9—9 of FIG. 8;

FIG. 10 is a rear elevational view of a modified cutter mounting plate shown removed from the can opener frame; and FIG. 11 is a fragmentary view of the modified cutter mounting plate latch and pin assembly shown in FIG. 10.

Turning now more particularly to FIGS. 1–3, a rigid, upright can opener frame is shown, indicated generally by the numeral 15. In the preferred embodiment the can opener frame is comprised of diecast metal or molded plastic. A box-like casing (not shown) abuts the rearwardly turned flange portions of the frame 15 to enclose the frame and to provide a housing for the motor and other internal parts. A can feed wheel 16 is threaded on can feed wheel drive shaft 17, which is journalled in a fixed boss (not shown) on frame 15 for rotation by a conventional electric motor through suitable reduction gearing generally indicated by numeral 18. Typical gearing and motor arrangements suitable for use with the instant invention are clearly disclosed in U.S. Pat. Nos. 3,724,069 (issued Apr. 3, 1973) and 3,787,967 (issued Jan. 29, 1974), and owned by the instant assignee.

Frame 15 is provided with four bosses **19*a*–19*d* (FIG. 1), which extend slightly forwardly from the front surface thereof and which provide a seat for the later-described cutter mounting plate 20. A conventional can guard 21 is located on frame 15 beneath the cutter mounting plate 20 (FIG. 3**).

Cutter mounting plate 20 is provided with a conventional compound angled boss 22 (FIG. 4) in which a suitable arbor or cutter stud is anchored. Cutter wheel 24 is journalled on the arbor stud for rotation with respect to the cutter mounting plate, and it is springably seated against the cap of washer head screw 25 (FIG. 3). A resilient right can guide 30, located on the cutter mounting plate, has an upper, transverse portion thereof which extends through slotted aperture 31 in the cutter mounting plate, terminating in a downwardly directed portion **30*a* (FIG. 4) which is fastened to the rear of cutter mounting plate 20 (at the interior surface thereof) by rivet 32**.

Cutter mounting plate 20 is pivoted for rotation with respect to the can opener frame by cylindrical pin member 27, which extends rearwardly therefrom to pivot in a suitable hole 29 (FIGS. 1, 2) in frame 15 when the cutter plate is attached thereto. A spring 36 (FIGS. 2 and 6), which is fastened to the frame by rivet 35, abuts pin 27 to yieldably prevent the cutter mounting plate 20 from moving forwardly when the later described latching arrangement is disengaged. As seen in FIGS. 4 and 6, pin member 27 is permanently and rigidly attached to the cutter mounting plate 20 by the combination of jam nut 28, which threadably engages an appropriately threaded portion (not shown) of pin 27, and flange 26, which compressively engages the rear of the cutter mounting plate (with latch 33 alignably and securely interposed therebetween) by jam nut 28.

The forwardly extending portion **27*a* (FIG. 6) of cylindrical pin member 27 serves as a left can guide, and cooperates with right can guide 30 to alignably maintain cans of various sizes in correct position with respect to the cutter wheel 24, and urge the rim of flange of a can downwardly into engagement with the teeth of can feed wheel 16 to provide required traction for feeding the can in respect to cutter wheel 24**.

Cutter mounting plate 20 is removably fastened to frame 15 by a latching arrangement, described in U.S. Pat. No. 3,688,400, issued Sept. 5, 1972, and owned by the instant assignee. The latching arrangement facilitates easy removal (and attachment) of the cutter mounting plate when the latter is oriented in the predetermined non-operating position (approximately 45° to 50° from the horizontal) shown in dotted lines in FIG. 3. Additionally, the latching arrangement securely maintains cutter mounting plate 20 in correct operating position during all phases of can opening operation.

The preferred latching arrangement comprises a latch 33 (FIGS. 4 and 6), which is fixedly attached to the cutter mounting plate 20, and a fixed latch plate 34 (FIGS. 1 and 6) which cooperates with latch 33 and is secured to the can opener frame (at the front therof) by rivet 35. Latch 33 is fixedly interposed between the flange 26 of the cylindrical pin member 27 (which extends through an appropriate hole therein) and the rear side of the cutter mounting plate 20. It is apparent that in an alternative embodiment the latch 33 could be fixedly attached to frame 15 and the latch plate 34 could be fixedly attached to the cutter mounting plate.

Latch 33 is provided with a generally arcuate edge portion 33*a*, which is offset from the rear of cutter mounting plate 20 by a predetermined distance (FIGS. 4 and 6). Latch plate 34 has a corresponding vertically oriented edge portion 34*a*thereof which is offset from the front of frame 15 by a predetermined distance such that when the latching mechanism is engaged, the inner surface of latch plate edge portion 34*a* glidingly contacts the outer surface of the corresponding latch edge portion 33*a* (FIG. 6). Cylindrical pin member 27 is thereby maintained within aperture 29, but at the same time rotation of the cutter mounting plate is facilitated. When the cutter mounting plate is rotated counterclockwise approximately 43° to 50° from horizontal to the position shown by the broken lines in FIG. 3, latch edge portion 33*a* (FIG. 4) will no longer contact the corresponding latch plate edge portion 34*a* so that the cutter mounting plate 20 may be removed from the can opener (i.e. cylindrical pin member 27 may be withdrawn from aperture 29).

In an alternative latching embodiment shown in FIGS. 7–9, a modified latch plate 40 requires additional manipulation before cutter mounting plate 20 (which must be oriented approximately 50° from the horizontal) can be removed from frame 15*a*. A pair of studs 42 and 44 are anchored within plate 40 (preferably by hot-heading process). Stud 42 extends rearwardly therefrom through an appropriate bearing aperture (not shown) within frame portion 15*a*. Stud 44 likewise extends rearwardly from plate 40 through an oversized, generally square aperture 46 in frame 15*a*. Studs 42 and 44 are similarly anchored within retainer plate 48 (FIG. 9) interiorly of the can opener to prevent axial displacement of plate 40. Pivotal motion of plate 40 about stud 42 is restrained by stud 44, the larger diameter portion 44*a* of which contacts the vertical opposite edges 46*a* and 46*b* of square aperture 46 to limit rotation of plates 40 and 48. Stud 44 is yieldably maintained against aperture edge 46*b* by spring 50, which extends between a tab portion 52 of plate 48 and an appropriate boss 54 interiorly of frame 15*a*. As viewed in FIG. 7, plate 40 can be rotated counterclockwise (until stud 44 contacts aperture edge 46*a*) by depressing a tab 56, which integrally extends outwardly from latch plate 40.

Latch plate 40 has a normally vertically (when viewed from the end as in FIG. 9) oriented upper portion 40*a* which is offset from frame 15*a* by a predetermined distance such that when the latching mechanism is engaged, the inner surface of portion 40*a* will glidingly contact the outer surface of the corresponding latch edge portion 33*a*. Cylindrical pin member 27 will be maintained within aperture 29*a* while rotation of the cutter mounting plate is facilitated. As indicated, the upper portion 40*a* of the latch plate 40 is of the same configuration as upper latch portion 34*a* described with respect to FIG. 6. When cutter mounting plate 20 is rotated counterclockwise approximately 45°, latch 33 can be disengaged from latch plate 40 by depressing tab 56 (against predetermined tension from spring 50) so that upper portion 40*a* will no longer engage latch edge portion 33*a*. To reinstall the plate 20, tab 56 must be again depressed so that edge 33*a* can properly engage edge 40*a* when plate 20 is rotated clockwise after being pushed rearwardly to seat against frame portion 15*a*.

An additional cylindrical pin member 50 (same being common to both embodiments, see FIGS. 6, 9) is fixedly attached to cutter mounting plate by riveting 61 and extends rearwardly therefrom, terminating in a slightly larger diameter cap portion 62 which is provided with a pair of opposing tapered shoulders 63 and 65. Pin member 60 engages generally arcuate slot 70 in frame 15 (FIGS. 1 and 2) or frame 15*a* (FIGS. 7 and 8) and cooperates therewith to maintain the cutter mounting plate in the desired position relative to the frame.

Slot 70 includes segment of an arc struck by rotation of the cutter mounting plate 20 with respect to aperture 29. For the majority of its length the width of slot 70 is approximately equal to the diameter of pin member 60. However, slot 70 terminates in a lower circular portion 72, the diameter of which is slightly larger than the diameter of cap portion 62 (on cylindrical pin member 60). To facilitate insertion of pin 60 (and more particularly cap 62) the circumscribing edge portion 74 of the lower portion of slot 72 is tapered slightly inwardly. During insertion of pin 60, cap shoulder portion 63 will glidingly contact the camming surfaces comprising tapered portion 74 to thereby guide pin 60 toward the correct position. Withdrawal of pin 60 will similarly be facilitated by the cooperation of inner cap shoulder portion 63 with inner tapered camming surface 75 (FIGS. 2 and 8). With the cutter mounting plate 20 oriented in the position shown in broken lines in FIG. 3, pin member 60 (and cap portion 62 thereof) will be appropriately positioned for engaging (or withdrawing from) circular portion 72 of slot 70.

In an alternative embodiment shown in FIGS. 10 and 11, an arcuate slot 80 is provided in a modified cutter mounting plate 20*a*, which is otherwise identical to plate 20. When necessary, the embodiment shown in FIGS. 10 and 11 could be combined with the embodiment shown in FIGS. 7–9.

Slot 80 receives a stationary capped pin member 82 (FIG. 11), which is press fitted within an opening 84 in a slightly altered frame 15*b*. Pin 82 is essentially a modification of pin 60 and comprises an elongated shank portion 86 which is firmly engaged in opening 84, a somewhat larger cylindrical portion 88 (the diameter of which is approximately equal to the width of slot 80) and a cap portion 90 (the diameter of which is approximately equal to circular opening portion 92 at the upper extreme of slot 80). Cap 90 has an outwardly diverging, inner shoulder portion 94 and a gradually tapered outer shoulder portion 95, which are respectively equivalent in function to tapered portions 63 and 65 of pin 60 described above. Portions 94 and 95 facilitate smooth penetration of and withdrawal from slot portion 92 by cap 90.

When the cutter mounting plate 20*a* is rotated approximately 50° counterclockwise (as viewed from the front of the can opener), pin 82 (and cap portion 90 thereof) will be appropriately positioned for engaging (or withdrawing from) circular portion 92 of slot 80. As the cutter mounting plate 20*a* is rotated clockwise toward its normal operating position, cap portion 90 will cooperate with latch 33 and plate 34 to maintain plate 20*a* in correct position relative to frame 15*b*.

Operation of the can opener is initiated by the hand operated piercing lever 100 (FIG. 1), which is pivoted to the can opener frame by cylindrical stud 102 (FIG. 5). Stud 102 which is rigidly secured to lever 100 by hot-heading 103, extends rearwardly from lever 100 through the oval (when viewed from the front as in FIG. 1) aperture 104 in frame 15. Pivot stud 102, which abuts a spacer washer 106 (FIG. 5), is fastened at the rear of an interior frame boss 108, which surrounds opening 104, in frame 15 by screw 110 (FIGS. 2 and 5) receiving threaded portion 111 thereof. A switch actuating lever 112 (FIGS. 2 and 5) is freely mounted between a washer 114 and washer 106 with the small diameter portion 116 of the washer 106 extending through an opening in lever 112.

As seen in FIG. 1, the hand operated piercing lever 100 has a slot 116 defined therein which extends radially outwardly from the pivot center of the hand lever (studd 102). Slot 116 receives guide stud 118, which extends rearwardly from cutter mounting plate 20 or 20*a* (FIGS. 4 and 10, respectively), to thereby mechanically link the cutter mounting plate with the hand piercing lever. Stud 118 is rigidly attached to the cutter plate by hot-heading 119 (FIG. 3). The cutter mounting plate and lever 100 together comprise a compound piercing lever assembly.

Stud 118 will always be located within engageable range of piercing lever slot 116 because the rotation of the cutter mounting plate is limited (to approximately 50°) by the previously discussed pin members 60 or 82 whenever they are inserted within the appropriate slotted aperture 70 or 80, respectively.

Cooperative alignment between the cutter mounting plate 20 and the hand piercing lever 100 is facilitated by extruded boss portion 120 (FIG. 1), which projects slightly outwardly from the piercing lever exterior surface to contact the inwardly facing surface of the cutter mounting plate to provide a seat for same. Additionally, a generally arcuate recess 122 located on the frame surface (FIG. 1), provides clearance for the inner end portion of guide stud 118 as it extends through the slot 116 of piercing lever 100.

Can piercing lever 100 is provided with a rearwardly turned portion 124 thereof which facilitates lever manipulation. The lower edge portion 125 of lever 100 contacts the upper left boss 19*a* (FIG. 1) of frame 15 to thereby limit counterclockwise lever movement. Heel portion 126 of lever 100 contacts the upper terminus 128 of a closure rib 129 (or alternatively an appropriate boss) on frame 15 to yieldably limit the clockwise (as viewed from the front) travel of lever 100 to approximately 90°. As will be discussed later, the latter features facilitate energization of accessory cutlery grinding means.

With reference to FIGS. 2 and 5, switch actuating lever 112 is pivotally mounted to frame 15 by pin 130, which is pressed into a suitable opening in the rear of the can opener frame. Lever 112 has a horizontally oriented oval opening therein (not shown) near its leftmost portion, through which the smaller diameter portion 116 of spacer washer 106 freely extends. The leftmost portion of switch actuating lever 112 is thus well aligned between stud 102 and washer 114.

Lever 112 is yieldably biased in an approximately horizontal position by tension spring 132, which is connected between lever arm hole 134 and lower frame boss 135. An inwardly turned portion 136 of lever 112 has a downwardly directed, convex shaped insulator 138 mounted thereon. Anchored in suitable slots or grooves 140 in the can opener frame are upper and lower switch contacts 141 and 142, respectively. Upper switch contact 141 is upwardly biased to normally seat against insulator 138. The lower switch contact 142 is upwardly biased to seat against a stop boss 144 provided on frame 15 (unless it is deflected downwardly by lever arm insulator 138 and the overlying upper switch contact 141). Switch contacts 141 and 142 are electrically wired in series with the motor (not shown) and motor operation is initiated when switch contact 141 engages switch contact 142 in response to clockwise pivotal deflection of switch actuating lever 112.

OPERATION

Before opening a can the user must swing the can piercing lever 100 clockwise from its normal horizontal rest position until the cutter wheel 24 is sufficiently separated from the underlying can feed wheel 16 to enable insertion of a can in the usual manner. When lever 100 is then swung counterclockwise, the cutter wheel 24 will seat downwardly on the end of the can and the rim or flange of the can will contact the toothed periphery of can feed wheel 16. As the lever 100 is swung counterclockwise (until further movement is prevented by engagement of under lever edge 125 with boss 19*a*), the end of the can is pierced by cutter wheel 24.

Before the end of the can is actually pierced, and while the piercing lever 100 is still being rotated counterclockwise, the upper edge 146 of piercing lever slot 116 will fulcrum on stud 118 (which extends rearwardly from the cutter mounting plate), causing stud 102 (FIG. 5) to move, against predetermined tension of spring 132, from its lowermost position in vertical opening 104 (FIGS. 1 and 5), to its uppermost position therein. With reference to FIG. 2, switch actuating lever 112 will thereby be rotated clockwise above pivot 130, forcing switch contacts 141 and 142 into engagement, thereby energizing the drive motor and initiating the rotation of can feed wheel 16. As stated, the motor is actually started and the can is fed by can feed wheel 16 before the end of the can is pierced by cutter wheel 24. However, continued counterclockwise swinging of lever 100 until under edge 125 thereof seats on stop boss 19*a* results in piercing of the end of the can by cutter wheel 24.

While the end is being sheared from the can, the can guides 27*a* and 30 urge the rim or flange of the can downwardly on the toothed periphery of can feed wheel 16, thereby insuring adequate traction of the teeth of the can feed wheel with the under edge of the can rim. Can guard 21 maintains the side wall of the engaged can at a predetermined angle with respect to can feed wheel 16. After the end has been completely sheared from the can, the motor will be stopped when the user swings the can piercing lever clockwise sufficiently to permit spring 132 to pull stud 102 back to its lowermost position in hole 104, thereby opening switch contacts 141 and 142 by pivoting lever arm 112 (FIG. 2). Some additional clockwise swinging of lever 100 permits removal of the can. Depending on how far clockwise the individual user rotates lever 100 when inserting a can in the can opener (or removing a can therefrom), latch 33 may or may not become unlatched from latch plate 34. However, if lever 100 is rotated sufficiently that latch 33 does become unlatched from latch plate 34, action of spring 36 will yieldably maintain cutter mounting plate 20 in its operating plane. However, inasmuch as latch 33 will always have several degrees engagement with latch plate 34 when cutter wheel 24 first seats on the end of a can, said plate 20 is always positively maintained in place by latch 33 and latch plate 34 as the end of the can is pierced.

To remove the cutter mounting plate 20, piercing lever 100 must be swung sufficiently clockwise (with respect to the front of the can opener) to rotate the cutter mounting plate approximately 43°. At this time, latch 33 will be disengaged from latch plate 34 (or plate 40) and pin member 60 will be positioned within arcuate slot 72 so that the cutter mounting plate may be withdrawn from the can opener simply by pulling it forwardly with respect to the frame (thereby removing cutter mounting plate pins 27 and 60 from orifices 29 and 72, respectively. When provided, however, latch 40 (FIGS. 7–8) must also be manipulated by depressing tab 56 to free latch 33. Operation of the embodiment (shown in FIGS. 10 and 11) is analogous to that discussed in conjunction with FIGS. 1–6.

The arcuate portion 148 of piercing lever 100 rotates the cutter mounting plate 20 to a position of 43° from horizontal. Plate 20 can be rotated an additional 7° (to 50° counterclockwise from horizontal) before stud 60 (by engagement with the lower end of slot 70) positively limits counterclockwise rotation of the cutter mounting plate 20. However, camming action between the tapered cap portion 63 of stud 60 and the slot of frame 15 is such that forward movement of plate 20 (after arriving at angle of 43°) will automatically rotate plate 20 to approximately 45° counterclockwise from horizontal, thereby freeing the plate from frame 15. Plate 20*a* is freed in a similar fashion to that described above.

To re-install the cutter mounting plate, it is necessary to orient the can piercing lever approximately vertically. With the cutter mounting plate positioned approximately 45° from the horizontal, pin member 27 is inserted into hole 29 so that latch 33 will engage latch plate 34 (or 40) when lever 100 is again swung counterclockwise. At the same time, pin member 60 is inserted into hole 72 (or alternatively pin member 82 is inserted into hole 92). The cutter mounting plate is then pushed rearwardly until it seats against the bosses 19*a*–19*d* and extrusion 120 on lever 100. Re-installation is facilitated by slightly oscillating the cutter mounting plate as it is pushed rearwardly so that guide stud 118 will move near the radial edge portion 148 of the can piercing lever. Camming action between the inner edges of stud cap 62 and either the upper or lower camming surfaces about opening 72 of frame 15 is such that the plate 20 will automatically be correctly positioned between 45° and 50° counterclockwise from horizontal when pushed rearwardly, even though it is anywhere between 30° and 60° before the user first moves it rearwardly. From the latter position (45° – 50° counterclockwise from horizontal), hook portion 150 of piercing lever slot 116 (FIG. 1) will automatically garner the stud 118 into the slot 116 as the can piercing lever 100 is swung counterclockwise. Further counterclockwise movement of lever 100 will pivot cutter mounting plate 20 such that latch 33 wil re-engage latch plate 34 (or plate 40).

As seen in FIG. 1, piercing lever 100 is provided with a generally vertical "heel" portion 126. When a can is not in the can opener, the motor may nevertheless be energized by moving the piercing lever to a substantially vertical position, such that the heel 126 engages the upper terminus 128 of rib portion 129 (or alternatively an appropriate boss) on the frame surface (FIG. 1). The resultant fulcrum will cause piercing lever stud 102 to be upwardly displaced within oval hole 104, upon approximately 7° additional clockwise rotation of lever 100, thereby closing switch contacts 141 and 142 by again pivoting switch actuating lever 112 (FIG. 2). As discussed before, the same vertical upward displacement of pin 102 occurs when a can lid is contacted by cutter wheel 24.

Thus, when motor driven cutlery grinding means, for example, are provided in a can opener constructed in accordance with the teachings of this invention, the grinding means may be utilized without inserting a can or adding or manipulating another switch. Importantly, piercing lever 100 may be utilized in conjunction with can openers whether or not cutlery grinding means or additional motor-driven accessories are included.

From the foregoing, it will be seen that this invention is one well adapted to attain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

Having thus described our invention, we claim:

1. A power operated can opener having an upright frame with a plurality of apertures defined therein, a rotary can feed wheel and motor means for rotating said can feed wheel, the combination therewith of:

a compound piercing hand lever assembly, said assembly including a removable cutter mounting plate having a cutter element mounted thereon, said plate having a first and second pin member extending therefrom, said first pin member being received within a first bearing aperture on said frame to thereby pivot said mounting plate with respect to said frame, a hand lever having a pin member extending therefrom, said pin member received within a second bearing aperture on said frame to thereby attach said hand lever to said frame and facilitate pivotal rotation of said hand lever with respect to said frame, said hand lever having an elongate slot defined therein for receiving said cutter mounting plate second pin member to thereby effect the rotation of said cutter mounting plate in response to movement of said hand lever, said slot extending inwardly into said hand lever from the periphery thereof, said cutter mounting plate second pin member being longitudinally movable in said slot;

said can opener further having a means for releasably mounting said cutter mounting plate to said can opener frame, said cutter mounting plate being retained on said frame by said releasable mounting means for a substantial portion of the pivot arc of said cutter mounting plate, said cutter mounting plate being separable from said can opener frame in response to rotation of said cutter mounting plate to a predetermined angular position; and means for actuating said motor means in response to predetermined movement of said hand lever.

2. The combination as in claim 1 wherein said means for releasably mounting said cutter mounting plate comprises:

a latch mounted on one of said cutter mounting plate and said frame; and a latch plate mounted on the other of said cutter mounting plate and said frame for engaging said latch for a substantial portion of the pivot arc of said cutter mounting plate to preclude axial separation of said first cutter mounting plate pin member from said first frame bearing aperture and releasing said latch in response to predetermined relative rotation of said latch.

3. The combination as in claim 2 including means mounting said latch plate for yieldable movement and means for moving said latch plate to effect the release of said latch therefrom.

4. The combination as in claim 2 wherein said means for releasably mounting said cutter mounting plate comprises means for cooperating in synchronism with said latch and said latch plate to retain said cutter mounting plate on said frame for a substantial portion of the pivot arc of said cutter mounting plate, said last mentioned means including a generally arcuate aperture located in one of said cutter mounting and said frame and having a predetermined width, said aperture terminating at one end thereof in a orifice having a diameter greater than said aperture width; and a capped pin member extending from the other of said frame and said cutter mounting plate for penetrating said orifice and having a diameter less than the width of said aperture, said capped pin member having a cap portion located on the end thereof having a diameter slightly less than the diameter of said orifice, said capped pin member being retained in said arcuate aperture for a substantial portion of the pivot arc of said cutter mounting plate and being separable from said orifice when said cutter mounting plate is rotated to a predetermined position.

5. The combination as in claim 1 wherein said hand lever slot extends generally radially outwardly from said hand lever pin member and comprises a hook portion for garnering said second pin member on said cutter mounting plate within said slot.

6. The combination as in claim 1 wherein said second bearing aperture in said frame comprises a vertically oriented oval hole having a lateral dimension substantially equal to the lateral dimension of said hand lever pin member, said hand lever pin member being vertically movable in said oval hole from a first rest position to a second position above said first position in response to upwardly directed forces on said hand operated piercing lever.

7. The combination as in claim 6 including spring means for yieldably biasing said hand lever pin member in said rest position.

8. The combination as in claim 6 including means to actuate said motor means in response to said upwardly directed forces on said hand operated piercing lever, said last mentioned means comprising:

an electric switch for energizing said motor means, and means for actuating said electric switch in response to vertical movement of said hand lever pin member within said second bearing aperture.

9. The combination as in claim 8 including means for producing said upwardly directed forces on said hand operated piercing lever to thereby energize said motor means without inserting a can into said can opener, said last mentioned means including a boss on said can opener frame, and means for fulcruming said hand lever on said boss when said hand lever is rotated to a predetermined position, said last mentioned means comprising a heel portion located on said hand lever for engaging said boss.

10. The combination as in claim 8, wherein the means for actuating said switch includes a lever member pivoted to said frame and directly connected to said hand lever pin member, the movement of said hand lever pin member to said second position thereof effecting pivotal movement of said lever member to actuate said switch.

11. The combination as in claim 2, including a spring mounted on said frame at a location to engage said first pin member to cooperate with said latch and latch plate in mounting said cutter mounting plate to said frame, said first pin member being adapted to be manually withdrawn from said first bearing aperture against the force of said spring when said latch and latch plate are disengaged.

* * * * *

UNITED STATES PATENT OFFICE
CERTIFICATE OF CORRECTION

PATENT NO. : 3,949,468
DATED : April 13, 1976
INVENTOR(S) : McLEAN, ROBERT E.; ABERER, LEO F.; ABERER, JAMES B.

It is certified that error appears in the above-identified patent and that said Letters Patent are hereby corrected as shown below:

Col. 2, lines 13 and 14, "engage" should be -- engaged --.

Col. 3, line 29, "omijtted" should be --omitted--.

Col. 4, line 52, "of" should be --or--.

Col. 6, line 19, between "includes" and "segment" insert --a--.

Col. 7, line 21, "studd" (first instance) should be --stud--.

Col. 9, line 67, "wil" should be --will--.

Signed and Sealed this
*twenty-ninth* Day of *June 1976*

[SEAL]

*Attest:*

RUTH C. MASON
*Attesting Officer*

C. MARSHALL DANN
*Commissioner of Patents and Trademarks*